US008858151B2

(12) United States Patent
Atkinson

(10) Patent No.: US 8,858,151 B2
(45) Date of Patent: Oct. 14, 2014

(54) MACHINE HAVING HYDRAULICALLY ACTUATED IMPLEMENT SYSTEM WITH DOWN FORCE CONTROL, AND METHOD

(75) Inventor: David C. Atkinson, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 181 days.

(21) Appl. No.: 13/210,653

(22) Filed: Aug. 16, 2011

(65) Prior Publication Data

US 2013/0045071 A1 Feb. 21, 2013

(51) Int. Cl.

| | |
|---|---|
| ***E02F 3/28*** | (2006.01) |
| ***E02F 3/36*** | (2006.01) |
| ***G06F 19/00*** | (2011.01) |
| ***E02F 1/00*** | (2006.01) |
| ***E02F 9/22*** | (2006.01) |
| ***E02F 3/43*** | (2006.01) |
| ***E02F 9/20*** | (2006.01) |

(52) U.S. Cl.

CPC ..... *E02F 3/434* (2013.01); *E02F 9/2217* (2013.01); *E02F 3/439* (2013.01); *E02F 9/2041* (2013.01)

USPC ..... 414/685; 414/815; 701/50

(58) Field of Classification Search

CPC ..... E02F 4/434; E02F 4/439; E02F 9/2203; E02F 9/2217; E02F 9/2289; E02F 9/2296; E02F 9/2041

USPC ..... 701/50; 414/685, 815; 60/445

See application file for complete search history.

(56) References Cited

U.S. PATENT DOCUMENTS

| | | | | | |
|---|---|---|---|---|---|
| 4,354,527 | A | * | 10/1982 | McMillan | 137/625.63 |
| 4,491,918 | A | * | 1/1985 | Yuki et al. | 701/50 |
| 4,630,526 | A | * | 12/1986 | Burk et al. | 91/452 |
| 4,852,660 | A | * | 8/1989 | Leidinger et al. | 172/795 |
| 5,000,650 | A | * | 3/1991 | Brewer et al. | 414/699 |
| 5,034,892 | A | * | 7/1991 | Saotome | 701/50 |
| 5,044,446 | A | * | 9/1991 | Jonasson et al. | 172/4.5 |
| 5,052,883 | A | * | 10/1991 | Morita et al. | 414/700 |
| 5,053,960 | A | * | 10/1991 | Brekkestran et al. | 701/51 |
| 5,116,188 | A | * | 5/1992 | Kurohashi et al. | 414/719 |
| 5,353,686 | A | * | 10/1994 | Nakamura | 91/461 |
| 5,471,770 | A | | 12/1995 | Ferreira | |
| 5,622,226 | A | * | 4/1997 | Hausman et al. | 172/4.5 |
| 5,720,214 | A | * | 2/1998 | Kawamura et al. | 91/522 |
| 5,741,112 | A | | 4/1998 | Lakin et al. | |
| 5,765,594 | A | * | 6/1998 | Collins et al. | 137/625.48 |
| 5,802,847 | A | * | 9/1998 | Harnischfeger | 60/413 |

(Continued)

FOREIGN PATENT DOCUMENTS

| | | | | |
|---|---|---|---|---|
| DE | 3541509 | A1 | * | 7/1987 |
| EP | 1657213 | A1 | * | 5/2006 |

(Continued)

*Primary Examiner* — Calvin Cheung

*Assistant Examiner* — Allen E Quillen

(74) *Attorney, Agent, or Firm* — Liell & McNeil

(57) ABSTRACT

A machine includes a frame having ground engaging propulsion elements coupled therewith, and a hydraulically actuated implement system having a linkage, an implement coupled with the linkage, and a hydraulic actuator coupled with the linkage. The machine further includes a control system having an electronic control unit configured to receive an implement down force control command, and responsively adjust a pressure of hydraulic fluid in the hydraulic actuator such that the implement rests with controlled down force upon a substrate below the machine. The controlled down force may be less than a quiescent down force of the hydraulically actuated implement system. Related methodology is also disclosed.

16 Claims, 4 Drawing Sheets

(56) References Cited

U.S. PATENT DOCUMENTS

| | | | | |
|---|---|---|---|---|
| 5,890,870 | A * | 4/1999 | Berger et al. | 414/699 |
| 5,897,287 | A * | 4/1999 | Berger et al. | 414/699 |
| 5,974,352 | A * | 10/1999 | Shull | 701/50 |
| 6,044,916 | A * | 4/2000 | Hundeby | 172/448 |
| 6,079,131 | A * | 6/2000 | Oshina et al. | 37/348 |
| 6,092,454 | A * | 7/2000 | Vande Kerckhove | 91/464 |
| 6,233,511 | B1 * | 5/2001 | Berger et al. | 701/50 |
| 6,385,519 | B2 * | 5/2002 | Rocke | 701/50 |
| 6,518,519 | B1 * | 2/2003 | Crane et al. | 177/136 |
| 6,578,295 | B1 * | 6/2003 | McPherson et al. | 37/403 |
| 6,633,804 | B2 * | 10/2003 | Dix et al. | 701/50 |
| 6,640,163 | B1 * | 10/2003 | Pfaff et al. | 700/282 |
| 6,648,576 | B1 * | 11/2003 | Duell et al. | 414/408 |
| 6,757,994 | B1 | 7/2004 | Hendron | |
| 7,104,181 | B2 * | 9/2006 | Bitter et al. | 91/437 |
| 7,124,576 | B2 * | 10/2006 | Cherney et al. | 60/414 |
| 7,210,395 | B2 * | 5/2007 | Strandberg et al. | 91/437 |
| 7,325,398 | B2 * | 2/2008 | Cherney | 60/476 |
| 7,383,682 | B2 * | 6/2008 | Kauss | 60/469 |
| 7,430,953 | B2 * | 10/2008 | Bitter | 91/437 |
| 7,448,309 | B2 * | 11/2008 | Bitter | 91/418 |
| 7,470,082 | B2 * | 12/2008 | Lloyd | 404/85 |
| 7,478,489 | B2 * | 1/2009 | Anderson et al. | 37/348 |
| 7,555,898 | B2 * | 7/2009 | Wada | 60/426 |
| 7,562,473 | B2 * | 7/2009 | Westendorf et al. | 37/407 |
| 7,571,942 | B2 * | 8/2009 | Shapiro et al. | 293/38 |
| 7,603,856 | B2 * | 10/2009 | Florean | 60/470 |
| 7,631,591 | B2 * | 12/2009 | Shelbourn et al. | 91/436 |
| 7,726,048 | B2 * | 6/2010 | Stanek et al. | 37/195 |
| 7,748,147 | B2 * | 7/2010 | Schoenmaker et al. | 37/348 |
| 7,752,778 | B2 * | 7/2010 | Schoenmaker et al. | 37/348 |
| 7,752,779 | B2 * | 7/2010 | Schoenmaker et al. | 37/348 |
| 7,753,132 | B2 * | 7/2010 | Stanek et al. | 172/2 |
| 7,797,860 | B2 * | 9/2010 | Schoenmaker et al. | 37/348 |
| 7,845,169 | B2 | 12/2010 | Brickner et al. | |
| 7,874,151 | B2 * | 1/2011 | Lin et al. | 60/422 |
| 7,891,121 | B2 * | 2/2011 | Smoljo | 37/447 |
| 8,046,939 | B2 * | 11/2011 | Hanson | 37/232 |
| 8,103,418 | B2 * | 1/2012 | Osswald et al. | 701/50 |
| 8,226,344 | B2 * | 7/2012 | Osanai et al. | 414/697 |
| 8,364,355 | B2 * | 1/2013 | Saito | 701/50 |
| 8,522,889 | B2 * | 9/2013 | Adams et al. | 172/4 |
| 8,577,561 | B2 * | 11/2013 | Green et al. | 701/50 |
| 2003/0001751 | A1 * | 1/2003 | Ogura et al. | 340/691.6 |
| 2003/0182748 | A1 * | 10/2003 | Watts | 15/83 |
| 2004/0060711 | A1 | 4/2004 | Charles | |
| 2004/0088972 | A1 * | 5/2004 | Harnischfeger et al. | 60/469 |
| 2005/0102081 | A1 * | 5/2005 | Patterson | 701/50 |
| 2006/0101815 | A1 * | 5/2006 | Kobayashi et al. | 60/413 |
| 2006/0104786 | A1 * | 5/2006 | Shepherd et al. | 414/699 |
| 2006/0263189 | A1 * | 11/2006 | Vigholm | 414/685 |
| 2007/0272134 | A1 * | 11/2007 | Baker et al. | 111/163 |
| 2009/0093934 | A1 | 4/2009 | Hanson | |
| 2009/0252586 | A1 * | 10/2009 | Sumiyoshi et al. | 414/685 |
| 2010/0162885 | A1 * | 7/2010 | Hughes et al. | 91/361 |
| 2010/0215469 | A1 * | 8/2010 | Trifunovic | 414/699 |
| 2010/0254793 | A1 * | 10/2010 | Trifunovic | 414/700 |
| 2010/0263735 | A1 * | 10/2010 | Vigholm et al. | 137/14 |
| 2011/0202232 | A1 * | 8/2011 | Busch et al. | 701/36 |
| 2012/0293316 | A1 * | 11/2012 | Johnson et al. | 340/438 |
| 2013/0032363 | A1 * | 2/2013 | Curry et al. | 172/4 |

FOREIGN PATENT DOCUMENTS

| | | |
|---|---|---|
| JP | 01-097725 | 4/1989 |
| JP | 1239231 | 9/1989 |
| JP | 2005307623 | * 11/2005 |
| JP | 2006045852 | * 2/2006 |
| JP | 2011202730 | * 10/2011 |
| JP | 2011214263 | * 10/2011 |

* cited by examiner

MACHINE HAVING HYDRAULICALLY ACTUATED IMPLEMENT SYSTEM WITH DOWN FORCE CONTROL, AND METHOD

TECHNICAL FIELD

The present disclosure relates generally to hydraulically actuated implement systems, and relates more particularly to controlling a hydraulically actuated implement system such that an implement rests with a controlled down force upon a substrate.

BACKGROUND

Hydraulically actuated implement systems of many different types are used in a broad variety of machines. Track-type tractors, backhoes, excavators, and wheel loaders are notable examples, having hydraulically actuated implement systems for digging, dozing, loading, spreading and all manner of other activities relating to manipulation of loose material and various other types of loads. Controlling a hydraulically actuated implement system with even reasonable efficiency and accuracy is by no means a simple task. Operators are typically tasked with manually manipulating various control levers while monitoring multiple operating conditions of the machine, whether stationary or traveling. It is thus unsurprising that even highly skilled operators with decades of experience are often able to improve performance with the assistance of various electronically controlled features of hydraulically actuated implement systems.

Over the years, engineers have proposed a great many different strategies for automating work cycles or parts thereof, such as material loading cycles whereby a machine captures, lifts and dumps material. Rather than requiring an operator to manually and repetitiously raise and lower the machine's lift arms, control tilting of the machine's bucket, and monitor and control the travel path and speed of the machine itself, a computer controls some or all of the functions of the implement system so that an operator can focus his attention elsewhere, or simply avoid fatigue.

Other examples of computer controlled processes include grading, trenching, and virtually any other common activity which can be performed by a human operator. Despite substantial advances in automated machine process technology, there nevertheless remain many instances where skilled operators can best computers in relation to at least certain aspects of a machine process, or where handing over control of an implement system to a computer for the totality of a work cycle is undesirable for other reasons. In still other instances, designing and implementing computer control for all aspects of a work cycle has proven to be very challenging, and often unnecessary to achieve real world efficiency gains. There thus remain ample opportunities for automating parts of machine work cycles, while leaving other parts to be controlled conventionally by an operator or by a separate control routine.

One example of an automated control strategy for a construction machine is known from U.S. Pat. No. 5,052,883 to Morita et al. In Morita et al., a work vehicle has an implement position controller. The controller is configured to automatically orient and position an implement, such as a bucket coupled with a linkage in a wheel loader. While Morita et al. appears to be an elegant strategy for attaining a pre-defined bucket orientation and position, especially for certain types of work cycles, there is always room for improvement, especially as new problems are recognized or created.

SUMMARY

In one aspect, a method of operating a machine including ground engaging propulsion elements and a hydraulically actuated implement system having a linkage and an implement includes receiving an implement down force control command, and adjusting a pressure of hydraulic fluid in a hydraulic actuator for the linkage, responsive to the command. The method further includes resting the implement upon a substrate below the machine such that the implement applies a controlled down force to the substrate which is based on the adjusted pressure.

In another aspect, a machine includes a frame and ground engaging propulsion elements coupled with the frame. The machine further includes a hydraulically actuated implement system coupled with the frame, and having a linkage configured to couple with an implement, and a hydraulic actuator coupled with the linkage. The machine further includes an electronic control unit configured to receive an implement down force control command, and responsively adjust a pressure of hydraulic fluid in the hydraulic actuator such that the implement rests with a controlled down force upon a substrate below the machine.

In still another aspect, a control system for a hydraulically actuated implement system in a machine includes an input device configured to generate an implement down force control command, and an electronic control unit coupled with the input device. The electronic control unit is configured to receive the implement down force control command and responsively command adjusting a pressure of hydraulic fluid in a hydraulic actuator for the implement system such that the implement rests with the controlled down force upon a substrate below the machine.

DETAILED DESCRIPTION

Figure 1:
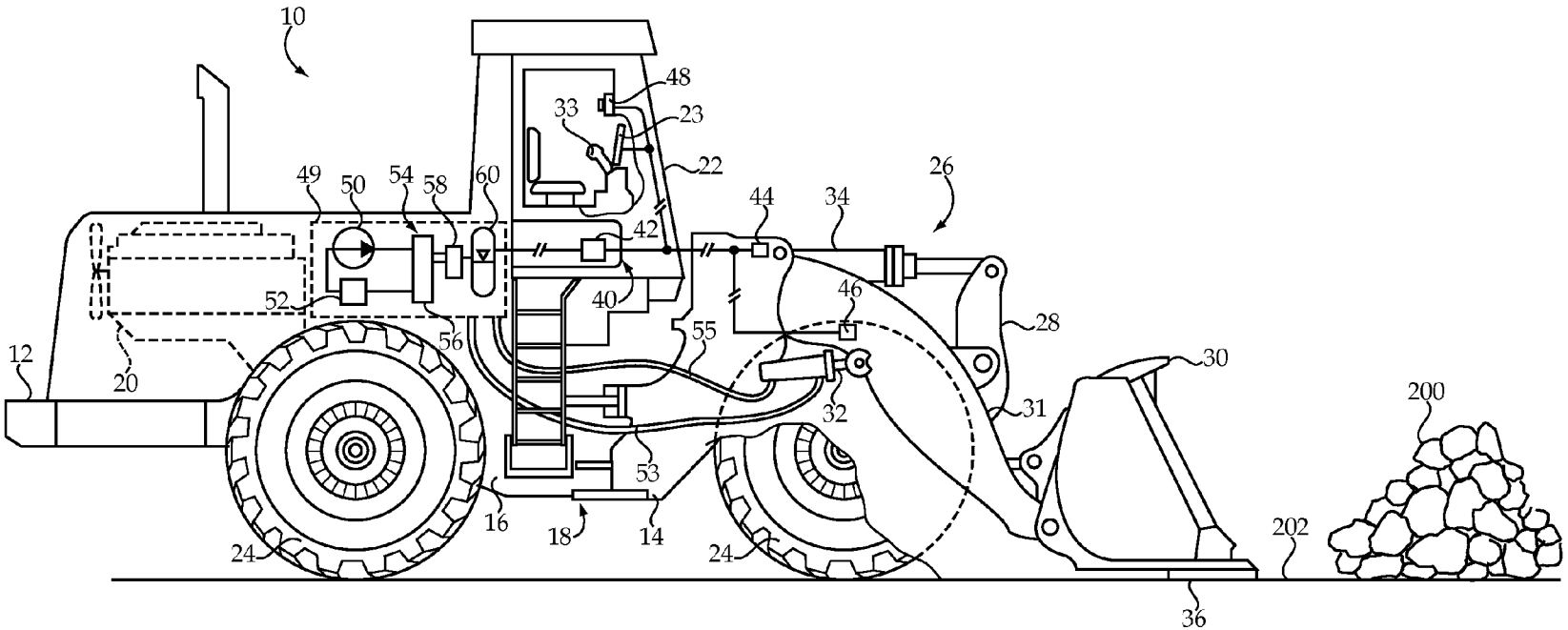
FIG. 1 is a side diagrammatic view of a machine, according to one embodiment.

Referring to FIG. 1, there is shown a machine 10 according to one embodiment. Machine 10 includes a frame 12 having a front frame unit 14, a back frame unit 16, and an articulation joint 18 coupling together frame units 14 and 16. An internal combustion engine 20 is mounted to frame 12, as is an operator cab 22. A set of ground engaging propulsion elements 24 are coupled with frame 12 in a conventional manner. A hydraulically actuated implement system 26 is coupled with frame 12, and includes a linkage 28 configured to couple with an implement 30. In the illustrated embodiment, linkage 28 includes a plurality of lift arms, one of which is shown and identified via reference numeral 31, and one or more hydraulic actuators 32 coupled with frame 12 and with linkage 28 for raising and lowering lift arm 31 and implement 30. Thus, lift arm 31 may be pivotably coupled with frame 12, and actuator 32 may include a lift actuator. Descriptions herein of lift arm 31 or actuator 32 in the singular should be understood to analogously refer to a plurality of lift arms and lift actuators, and vice versa. Implement system 26 may further include a tilt actuator 26 coupled with implement 30 and configured to tilt implement 30 relative to lift arm 31 in a conventional manner.

A variety of different features may be positioned within operator cab 22 for controlling and operating various aspects of machine 10, including a set of control levers 33, an input device 48, and a display 23 or similar operator interface. Machine 10 is shown in the context of an articulated wheel loader such as might be used for moving, loading and/or distributing loose material at a work site. A variety of other machine types are contemplated within the context of the present disclosure, however. For instance, machine 10 might include a track-type tractor having ground engaging tracks rather than wheels as shown. A variety of different implement types might also be used with machine 10. Implement 30 is shown as a bucket, however, a blade, a fork, a rotary broom, or any of a variety of other implement types might be used. One practical implementation strategy contemplates using machine 10 at a waste transfer station, for reasons which will be apparent from the following description.

Machine 10 may further include a hydraulic subsystem 49 having a pump 50, a tank 52, and a valve assembly 54 having a first valve body 56 and a second valve body 58, as well as an accumulator 60. A rod side hydraulic conduit 53 extends between hydraulic subsystem 49 and actuator 32, as does a head side hydraulic conduit 55. As further described herein, implement system 26 may be uniquely configured to controllably position implement 30 upon a substrate 202 such as a concrete floor below machine 10. For waste transfer applications, as well as others, a substrate protection pad 36 formed from rubber or the like may be coupled with implement 30 such that moving machine 10 across substrate 202 can slide pad 36 in contact with substrate 202, to squeegee liquid from substrate 202 or for other purposes, without scraping substrate 202 with implement 30. Also shown in FIG. 1 is a material pile 200 such as a pile of loose waste material located upon substrate 202. Machine 10 may be used to capture, lift and dump material from pile 200 into a haul truck or the like by way of a plurality of successive passes. During each pass, implement system 26 may be operated such that implement 30 controllably rests upon substrate 202 as machine 10 travels across substrate 202 to engage with material pile 200, as further described herein.

In earlier systems, it was common for machines similar to machine 10 to scrape an implement across an underlying substrate such as the concrete floor of a waste transfer station between capture lift and dump cycles, often resulting in damage to the substrate and/or the implement. While substrate protection pads such as pad 36 were also commonly used with prior machines, and had some success in protecting implements as well as concrete floors, the pads themselves were subjected to substantial wear and needed regular replacement. The present disclosure addresses these and other concerns by enabling a down force of an implement such as implement 30 to be controlled when resting upon a substrate such that wear and tear on the implement or substrate protection pad, as well as the substrate itself, is substantially reduced or eliminated.

To this end, machine 10 may further include a control system 40 for implement system 26 having an electronic control unit 42 configured to receive an implement down force control command, and responsively adjust a pressure of hydraulic fluid in hydraulic actuator 32 such that implement 30 rests with a controlled down force upon substrate 202 below machine 10. Implement 30 may be "rested" in this manner while machine 10 is traveling, or while machine 10 is stopped. In the illustrated embodiment, electronic control unit 42 may control the down force by way of controlling hydraulic fluid pressure in actuator 32. The present disclosure is not thusly limited, however, and in parallel or as an alternative, hydraulic pressure in tilt actuator 34 might be adjusted or otherwise controlled to influence down force applied by implement 30 to substrate 202.

Those skilled in the art will be familiar with the wide variety of different implement system designs used in modern machines. Numerous modifications to the basic design of implement system 26 might be made without departing from the scope of the present disclosure. For instance, rather than two lift arms, a single lift arm might be used. Analogously, rather than a one-piece rigid lift arm, a multiple piece linkage might be used having, for instance a stick, a boom and one or more pivot points between the coupling of the linkage with the frame and the coupling with the implement. As noted above, electronic control unit 42 may receive an implement down force control command. In one embodiment, the implement down force control command may be generated via an input device 48, which can comprise a manually operated button, voice activated mechanism, switch or the like positioned within operator cab 22 and coupled with electronic control unit 42. In other embodiments, input device 48 might operate autonomously. In other words, rather than an operator selectively activating input device 48 to command control of implement down force, a computer might make the decision to output the implement down force control command.

It will be readily apparent to those skilled in the art that implement system 26 may be brought to rest upon substrate 202 by lowering lift arm 31 until pad 36 contacts substrate 202. Any time implement system 28 is thusly brought to rest, it will contact substrate 202 via pad 36 and apply a down force to substrate 202. When implement system 26 is operated such that actuator 32 or actuator 34 opposes a force of gravity while implement 30 and/or pad 36 contacts substrate 202, the down force may be less than a down force defined by a resting weight of implement system 26. Where implement system 26 is operated such that actuator 32 or 34 complement the force of gravity to push implement 30 and/or pad 36 downwardly against substrate 202, the down force may be greater than a down force defined by resting weight of implement system 26. The resting weight, such as might occur where machine 10 is not running and hydraulic subsystem 49 is turned off, may be understood to define a quiescent down force. The quiescent down force may thus be further understood as the force in a vector direction normal to substrate 202 when implement system 26 is neither pushing down or pulling up. As noted above, in certain service applications sliding of implement 30 and/or pad 36 across a substrate can damage the substrate and/or implement or cause undue wear to the pad. It has been discovered that controllably resting implement system 26 such that the down force applied to substrate 202 is less than the quiescent down force can decrease or substantially eliminate these problems.

In other embodiments, electronic control unit 42 might be configured to control the down force such that it is greater than a quiescent down force of implement system 26, for various purposes such as scraping material or squeegee-ing liquids from a substrate, and even for enabling or enhancing certain types of traction control. As will be further apparent from the following description, certain hardware and control features of implement system 26 and control system 40 enable these capabilities.

Figure 2:
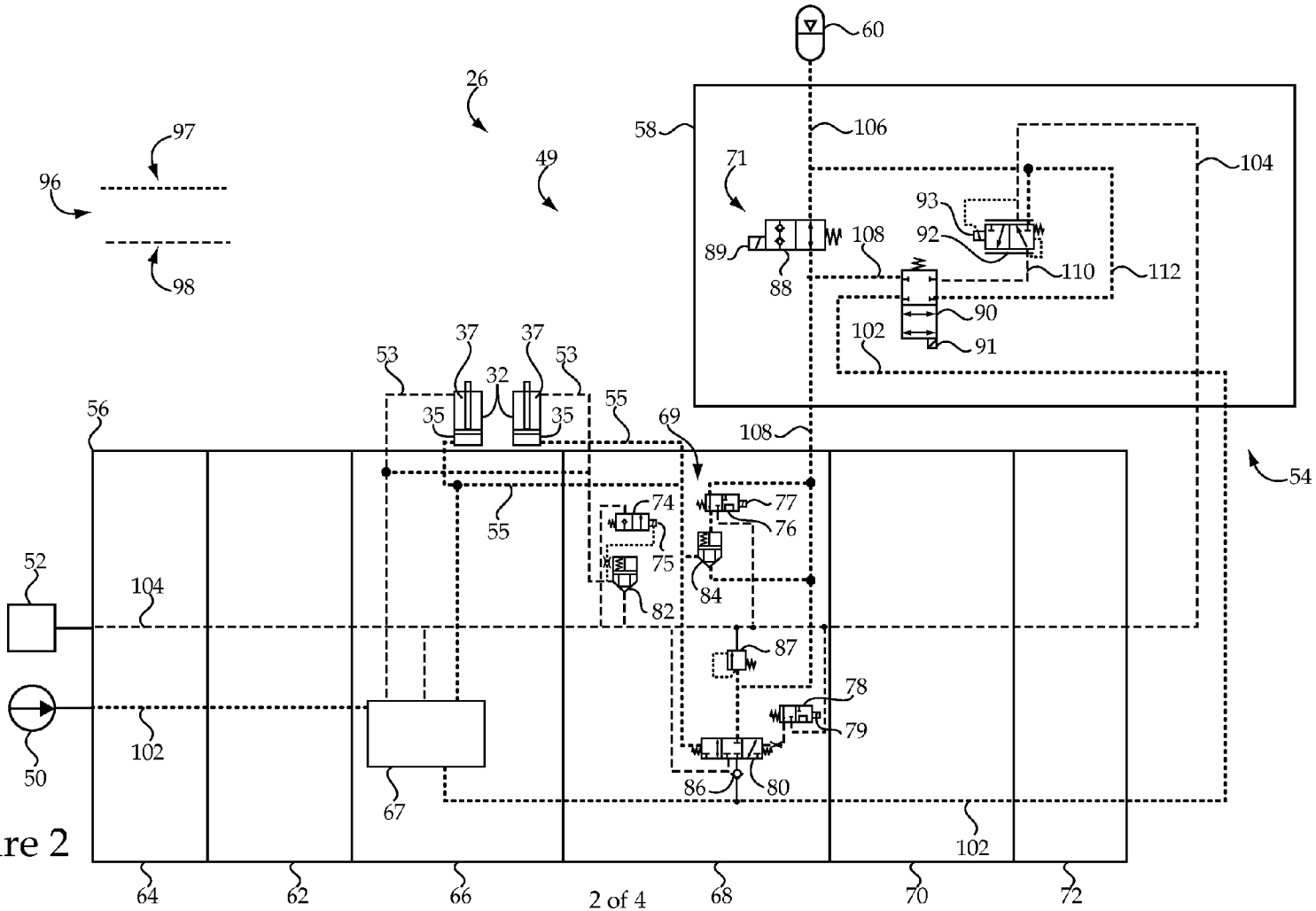
FIG. 2 is a schematic illustration of a hydraulically actuated implement system suitable for use with the machine of FIG. 1, in a first configuration.

Turning now to FIG. 2, there is shown a schematic view of certain parts of implement system 26, illustrating additional detail over what is shown in FIG. 1. In FIG. 2, two lift actuators 32 are shown fluidly communicating with valve assembly 54 by way of head side conduit 55 and rod side conduit 53. Reference numeral 35 denotes a head side chamber of each one of actuators 32, whereas reference numeral 37 identifies a rod side chamber. As mentioned above, valve assembly 54 may include a first valve body 56 and a second valve body 58. Valve bodies 56 and 58 may be mounted together on back frame unit 16 of machine 10, but one or both might instead be mounted on front frame unit 14 in other embodiments, or integrated into a single valve body. Valve body 56 is shown as a sectional hydraulic valve and is suitable for use in an open center hydraulic system. The present disclosure is not thereby limited, however, and a closed center hydraulic system and/or a variety of different valve body configurations might instead be used. Valve body 56 may further include an inlet section 62, a tilt section 64, and a lift section 66. Tilt section 64 may include various valves and passages adapted for controlling tilt actuator 34 in a conventional manner. Accordingly, tilt section 64 might include an operator controlled tilt valve coupled with one of control levers 33, and also potentially coupled with electronic control unit 42 for automated control, although such features are not specifically shown in FIG. 2. It should also be appreciated that while the present disclosure focuses on controlling lift actuators 32, as alluded to above tilt actuator 34 might be controlled for purposes analogous to those discussed herein in connection with lift actuators 32. A lift valve 67 may be located in section 66 and operably coupled with one of control levers 33 in a conventional manner, and also coupled with electronic control unit 42 for automated control. Lift valve 67 and other features within section 66 may be understood as a primary hydraulic control circuit. Valve body 56 may further include a ride control section 68, including a ride control hydraulic circuit 69 for purposes further discussed herein. Valve body 56 may still further include an auxiliary section 70 for connected with or incorporating auxiliary hydraulic devices, and an outlet section 72. Valve body 58 may include a down force hydraulic control circuit 71 operable in a manner also further discussed herein.

In one practical implementation strategy, ride control circuit 69 may include a plurality of components located, for example, in section 68 and configured to implement a ride control feature of implement system 26 whereby shocks and vibrations imparted to machine 10 during operation, such as while carrying a bucket load of material or a suspended load with implement 30, can be absorbed. To this end, when the ride control feature is activated, lift valve 67 may be placed in a neutral position, and ride control circuit 69 used to fluidly connect head side chambers 35 with accumulator 60 in a known manner. In other instances, where the ride control feature is not being used, certain of the features of ride control circuit 69 may be used in conjunction with down force control circuit 71 to controllably rest implement 30 upon substrate 202 in a manner further described herein.

In one embodiment, ride control circuit 69 may include a plurality of valves configured to control fluid connections within implement system 26. In particular, ride control circuit 69 may include a first valve 74 coupled with a first electrical actuator 75, in turn controllably coupled with electronic control unit 42. Ride control circuit 69 may further include a second valve 76 coupled with a second electrical actuator 77, also controllably coupled with electronic control unit 42, and a third valve 78 also coupled with a third electrical actuator 79, also controllably coupled with electrical actuator 42. A fourth valve 80, which may include a passively operated three-position pressure control valve 80, may also be included, as may a first check 82, a second check 84, and a third check 86. A pressure relief valve 87 is also disposed in ride control circuit 69.

It may further be noted that a plurality of different fluid conduits or passages are shown in FIG. 2, defined in part by valve body 56 and also in part by valve body 58. In particular, an inlet passage 102 extends through a plurality of the sections of valve body 56, and also through valve body 58, and fluidly connects with pump 50. An outlet passage 104 similarly extends through a plurality of valve sections of valve body 56, and also through valve body 58. Outlet passage 104 connects to tank 52. An accumulator passage 106 fluidly connects with accumulator 60, and is selectively connectable with a pressure control passage 108, connecting between and defined in part by each of valve bodies 58 and 56.

Down force control circuit 71 may also include a plurality of electrically actuated valves, including a first valve 88 which includes a two-position valve having an electrical actuator 89, and being movable between a first position at which accumulator passage 106 fluidly connects with pressure control passage 108, and a second position at which fluid communication between the respective passages is blocked. A second valve 90 having a second electrical actuator 91 may also be a two-position valve, as may a third valve 92 having a third electrical actuator 93. At a first position of valve 90, fluid communication between inlet passage 102 and valve 92, as well as fluid communication between pressure control passage 108 and valve 92, are blocked. At a second position of valve 90, fluid communication between inlet passage 102 and valve 92, as well as fluid communication between pressure control passage 108 and valve 92, are open. At a first position of valve 92, a connector passage 110 extending between valve 92 and valve 90 may be open to drain passage 104. At a second position of valve 92, connector passage 110 may be open to another connector passage 112 extending between valve 92 and valve 90. A position of valve 90 thus determines whether connector passages 110 and 112 are connected with pressure control passage 108 and inlet passage 102. Accordingly, it will understood that whether pressure control passage 108 is connected with drain passage 104 or with inlet passage 102 may depend upon the state of each of valves 90 and 92, the significance of which will be apparent from the following description. Each of valves 88, 90 and 92 may be controllably coupled with electronic control unit 42.

In one practical implementation strategy, the first position of valve 88 may include a de-energized position, such that electronic control unit 42 may energize actuator 89 to adjust valve 88 to its second position to block fluid communication between passages 106 and 108. The first position of valve 90 may also be a de-energized position, such that electronic control unit 42 can energize actuator 91 to adjust valve 90 to its second position at which passage 108 fluidly connects with passage 110 and passage 102 fluidly connects with passage 112. The first position of valve 92 may also include a de-energized position. Valve 92 may include a two-position valve as mentioned above, such that energizing actuator 93 adjusts valve 92 from its first position to its second position. Valve 92 might also include a plurality of energized positions, each of which defines a different state of fluid communication between passage 112 and passage 110, for purposes further described herein. Each of the electrical actuators for the various valves discussed herein may include a solenoid actuator. Accordingly, electrical actuator 42 may control a current to the respective solenoids to adjust the valves between their first and second positions, and in the case of valve 92 may control electrical current to the respective solenoid to position valve 92 at any of a number of positions greater than two, each corresponding to a different connection state between passages 112 and 110, for instance, and different states of pressure reduction from passage 112 to passage 110, as further described herein.

In general terms, ride control circuit 69 may be used to switch implement system 26 from a first state at which an operator is able to manually control actuators 32 in a conventional manner to a second state at which pressures of hydraulic fluid in actuators 32 are maintained generally at a set point, but accumulator 60 used to receive and supply fluid to assist in absorbing shocks. Down force control circuit 71 may be used generally to control a pressure of hydraulic fluid supplied to hydraulic actuators 32 to control down force of implement system 26 when neither manual control or ride control is desired. Those skilled in the art will readily understand that a variety of different hydraulic system architectures might be used to enable these capabilities. Embodiments are therefore contemplated which do not include a ride control circuit at all.

Since down force control according to the present disclosure may be understood as an alternative control strategy to manual control, when down force control is initiated, a pressure of hydraulic fluid in hydraulic actuators 32, and in one embodiment a pressure of hydraulic fluid in head side chambers 35, may be adjusted from whatever pressure prevails prior to initiating down force control. Accordingly, when an implement down force control command is received, down force control circuit 71 may adjust a pressure of hydraulic fluid in chambers 35 responsive to the control command. The adjusted pressure may then determine the down force applied by implement 30 when resting upon substrate 202. Methodology relating to these capabilities will be further apparent from the following discussion of example states of implement system 26 and control of the various components of ride control circuit 69 and down force control circuit 71.

In FIG. 2, each of valves 88, 90 and 92 may be de-energized. Valve 78 may be energized, whereas each of valves 74 and 76 may be de-energized. This may be understood as a state at which ride control is off and down force control is off, such as where the operator desires manual control. Accordingly, pressures of hydraulic fluid at various points throughout implement system 26 may be determined based at least in part upon an operator's manipulation of control levers 33. In FIG. 2, a legend 96 is shown which indicates example pressures in various of the fluid passages of system 26. In particular, reference numeral 97 indicates a pattern used to show passages which may be at or close to a pump outlet pressure, particularly where lift control valve 67 is in a raise position, whereas reference numeral 98 is used to indicate a different pattern showing passages which are at or close to a tank pressure. It may be noted that passages 102, 112, 106 and 108 are at the pump outlet pressure, as is passage 55. Passage 110 is at tank pressure, as is passage 53. When desirable to activate ride control, valve 78 may be de-energized, and each of valves 74 and 76 may be energized. Lift control valve 67 may be moved to or remain in a neutral position. As noted above, activating and de-activating ride control generally occurs in a known manner.

Figure 3:
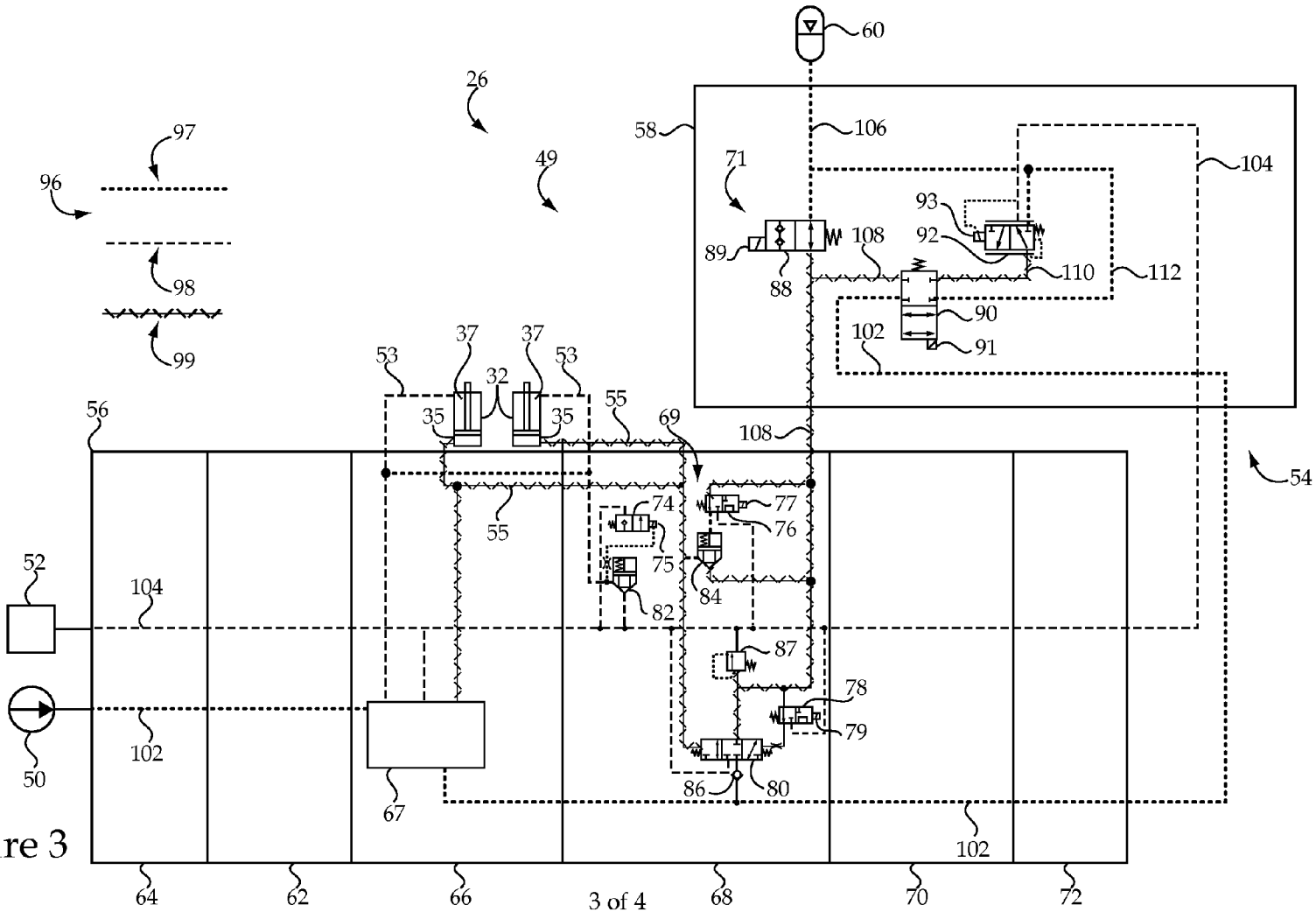
FIG. 3 is a schematic illustration of the hydraulically actuated implement system of FIG. 2, in a second configuration.

Referring now to FIG. 3, there is shown implement system 26 depicting pressures in the various passages as they might appear where ride control is turned off, and down force control is turned on. Legend 96 also shows via reference numeral 99 a different pressure which prevails in head side chambers 35, as well as other passages within system 26. The pressure illustrated via reference numeral 99 may be fluid pressure reduced from pump outlet pressure via valve 92. At the state shown in FIG. 3, valve 78 is de-energized, and each of valves 74 and 76 are energized, whereas each of valves 88, 90 and 92 are energized. It will therefore be understood that a difference between a state at which ride control is turned on, and a state at which ride control is turned off but down force control is turned on as depicted in FIG. 3, may be the energization of valves 88, 90 and 92. Those skilled in the art will further appreciate that rather than energizing valves 88, 90 and 92 to activate down force control, in alternative embodiments the valves might be de-energized to change positions, and the pattern of energized versus de-energized is chosen only as a matter of convenience and efficiency. Further still, it should be understood that pressures depicted in FIGS. 2 and 3 are merely illustrative snapshots, and during adjusting and operating system 49, specific pressures may differ from those illustrated and discussed herein.

In FIG. 3, inlet passage 102 is fluidly connected to passage 112, and passage 112 is in turn fluidly connected to passage 110. Passage 110 is connected to passage 108 such that a pressure of fluid supplied to passage 108 will typically be a pump outlet pressure reduced via valve 92. To this end, valve 92 may be understood as an electronically actuated reducing valve configured to convey hydraulic fluid from pump 50 to chamber 35, at a down force controlling pressure which is less than an outlet pressure of pump 50. In response to the down force control command, valve 92 may be further understood to move from a passive position, connecting passage 110 to tank pressure, to a pressure reducing position, connecting passage 110 to a pressure less than pump outlet pressure. Provision of pump outlet pressure to passage 112 when down force control is turned on can also enable accumulator 60 to be charged during down force control. It should be appreciated that the pressure supplied to head side chambers 35 may be only slightly less than pump outlet pressure. This would be the case where hydraulic signaling lines or the like are used to control a displacement of pump 50. In other words, as a matter of energy efficiency, it might be desirable to avoid operating pump 50 to pressurize fluid far above what is needed, and known mechanisms for controlling pump displacement may be used to bring pump outlet pressure fairly close in line with the pressure to actuators 32 which is needed to control the down force of implement 30 as desired.

It will be recalled that valve 92 might have a number of different positions or states, each of the positions or states corresponding to a different extent of pressure reduction. In other words, while valve 92 may fluidly connect passage 110 with passage 104 when de-energized, a plurality of different energized positions or states of valve 92 might be provided such that at each different position or state a different pressure can be supplied to passage 110. This capability may be leveraged to allow different degrees of down force of implement 30 to be specified or selected by an operator. This capability may also enable different implements having different weights or different uses to be swapped for bucket 30 without needing to reconfigure hydraulic subsystem 49 or control logic of control system 40. Valve 92 may include a single spool valve, but might also include an assembly of valves in certain embodiments.

In one embodiment, electronic control unit 42 may include or be coupled with a computer readable memory such as RAM, ROM, a hard drive, or some other form of memory. The memory may store implement type data as well as valve state data. Upon receiving an implement down force control command as described herein, electronic control unit 42 may electronically read the stored implement type data and stored valve state data. One embodiment contemplates a multidimensional map having an implement type coordinate and a valve state coordinate. When electronic control unit 42 outputs a control signal such as an electric current to valve 92, the control signal may be based upon the stored implement type data and the stored valve state data such that a valve position or valve state is commanded which corresponds with a particular type of implement, or a particular application for an implement. Electronic control unit 42 may determine the implement type presently coupled with implement system 26, for instance, by reading a radio frequency identification device attached to the implement.

One implementation of such capability might include using machine 10 for a first purpose such as squeegee-ing a floor and/or loading material, and then swapping bucket 30 for a different implement such as a rotary broom. In the first case, a first position of valve 92 could provide for an appropriate down force of implement 30, less than the quiescent down force of implement system 26, whereas a different valve position could provide for a different down force using a different implement. Those skilled in the art will contemplate many different applications of these general principles.

INDUSTRIAL APPLICABILITY

Figure 4:
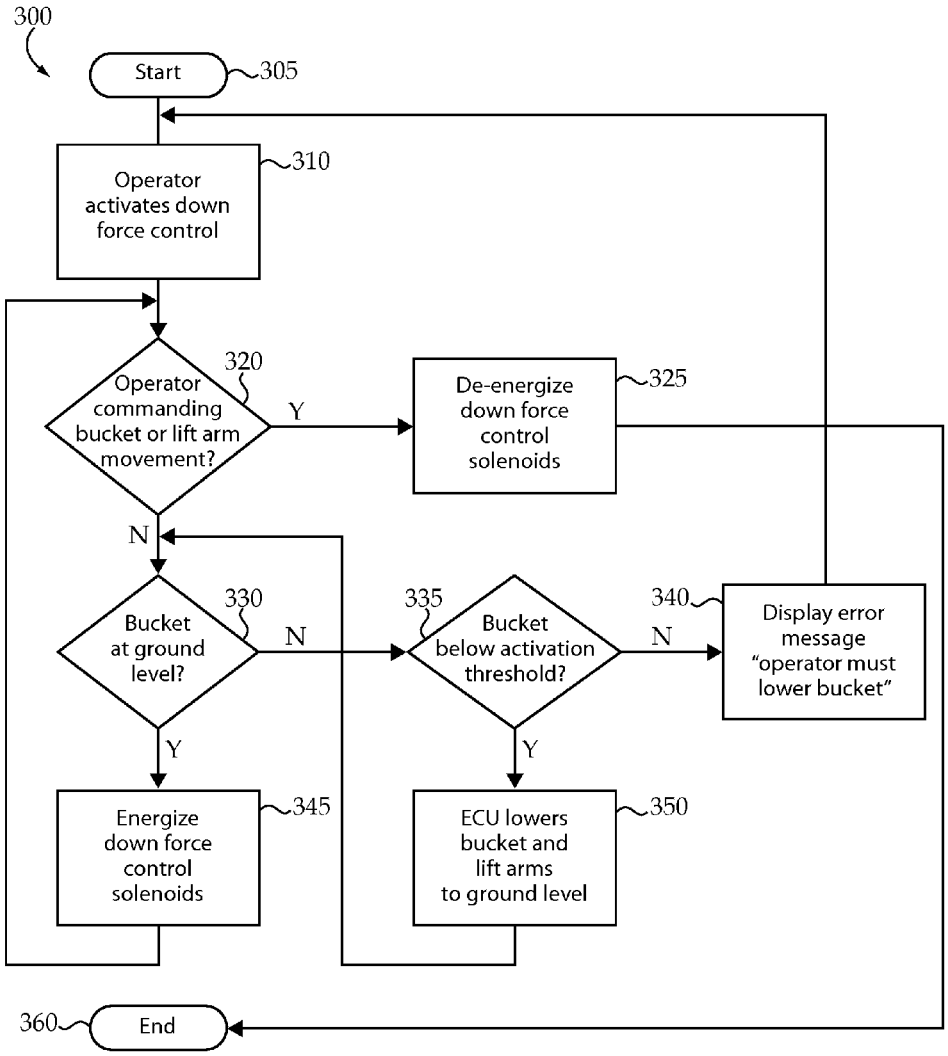
FIG. 4 is a flowchart illustrating a control process, according to one embodiment.

Referring now to FIG. 4, there is shown a flowchart 300 illustrating example steps in a control process according to the present disclosure. The process of flowchart 300 may start at step 305, and proceed to step 310 at which the operator activates down force control. Step 310 may be considered analogous to electronic control unit 42 receiving an implement down force control command as described herein. From step 310, the process may proceed to step 320 at which electronic control unit 42 may query whether the operator is commanding bucket or lift arm movement. If yes, the process may proceed to step 325 at which electronic control unit 42 may de-energize down force control solenoids, for instance solenoids comprising electrical actuators 89, 91 and 93, if these actuators are currently energized. Thus, at step 325, electronic control unit 42 may be determining whether the operator is intending to interrupt down force control, for instance, as might occur where the operator is attempting to raise lift arms 31 and/or tilt implement 30 to begin capturing material. From step 325, the process may proceed to end at step 360. If, at step 320, the operator is not commanding bucket or lift arm movement, the process may proceed to step 330. At step 320, the determination as to whether the operator is commanding bucket or lift arm movement might be made in several ways. For instance, sensors might be coupled with control levers 33 to indicate whether the position or motion of control levers 33 indicates that the operator is attempting to move implement 30 by way of actuator 34 or 32. Alternatively, sensors might be positioned elsewhere in implement system 26 or on machine 10 to determine whether the operator is taking these or other actions which might justify interrupting the down force control methodology. Position sensors 44 and 46 might also be used for this and similar purposes.

At step 330, electronic control unit 42 may query whether the bucket is at ground level, for instance by interrogating or monitoring signals from sensors 44 and 46. If the bucket is not at ground level at step 330, the process may proceed to step 335 to query whether the bucket is below an activation threshold. If the bucket is not below the activation threshold, the process may proceed to step 340 to display an error message such as an error message on display 23 instructing the operator to lower the bucket. From step 340, the process may return to execute step 310 and those subsequent once again. If, at step 335, the bucket is below the activation threshold, which might include a threshold of a few inches or a few feet above the substrate, the process may proceed to step 350 at which electronic control unit 42 may automatically lower implement 30 and lift arm 31 to ground level, such as by controllably reducing pressure to actuators 32 until signals from sensors 44 and 46 indicate that ground level has been reached, or via some other closed loop or open loop strategy. From step 350, the process may return to execute step 330 and those subsequent again.

If, at step 330, the bucket is at ground level, the process may proceed to step 345 to energize the down force control solenoid valves as described herein, including valves 88, 90 and 92. Thus, at step 345, electronic control unit 42 may be understood to actuate valve 92 and effectively commanding adjustment of pressure to chambers 35 via a control signal to valve 92. Process 300 may continue looping back via the various pathways until step 320 renders a positive result, at which the process may proceed to end at step 360.

It is contemplated that down force control may be activated at some point after an operator has dumped material with machine 10 in a loading cycle, and is proceeding to capture and dump an additional load of material. Accordingly, it is expected that the operator may activate down force control, such as via input device 48, while lift arms 31 are being lowered. Thus, each time an operator completes a dump, she may lower the lift arms towards the substrate beneath the machine in preparation for driving towards and into a pile of material. Embodiments are contemplated in which electronic control unit 42 controllably lowers lift arms 31 until such point at which a desired down force, less than the quiescent down force, is applied by implement 30 on substrate 202. In such case, the controlled down force may be attained by decreasing pressure to chambers 35. In one practical implementation strategy, however, whether initiated by the operator or via electronic control unit 42, implement 30 may be rested upon substrate 202 such that its full-weight, quiescent down force is applied to substrate 202, and then pressure in chambers 35 increased. In other words, the operator or electronic control unit 42 may bring implement system 26 briefly to rest, upon substrate 202, and then a pressure of hydraulic fluid in head side chamber 35 increased to decrease down force, but not so much that implement 30 is lifted off of substrate 202. Subsequent to or during adjusting hydraulic pressure such that implement 30 applies the controlled down force, the operator may commence moving machine 10 over substrate 202. It will thus be understood that implement 30 may rest with the controlled down force upon substrate 202 during moving machine 10 across substrate 202, and further such that substrate protection pad 36 slides in contact with substrate 202, imparting the advantages of reduced wear and tear on implement system 26 as well as substrate 202 itself.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A method of operating a machine including ground engaging propulsion elements and a hydraulically actuated implement system having a linkage and an implement, the method comprising the steps of:

fluidly connecting a hydraulic actuator for the linkage to an inlet passage via a first valve conveying hydraulic fluid to the hydraulic actuator at an outlet pressure of a hydraulic pump of the implement system;

receiving via an electronic control unit an implement down force control command;

adjusting the pressure of hydraulic fluid in the hydraulic actuator from the pump outlet pressure to an adjusted pressure via the electronic control unit at least in part by opening another fluid connection from the hydraulic actuator to the inlet passage via a second valve, responsive to the command, and moving the first valve to a neutral position such that the corresponding fluid connection is shut;

resting the implement upon a substrate below the machine such that the implement applies a controlled down force to the substrate which is based on the adjusted pressure and is less than a quiescent down force of the hydraulically actuated implement system;

the step of adjusting further including a step of conveying hydraulic fluid to the hydraulic actuator from the inlet passage via the second valve such that a pressure of the hydraulic fluid is reduced by the second valve from the pump outlet pressure in the inlet passage to the adjusted pressure;

the step of conveying hydraulic fluid further including conveying the hydraulic fluid from the hydraulic pump to a head-side chamber of the hydraulic actuator by way of a reducing valve that includes the second valve;

electronically reading stored implement type data, and stored valve state data; and moving the reducing valve responsive to the implement type data and the valve state data.

2. The method of claim 1 wherein the step of adjusting further includes increasing a pressure of hydraulic fluid in a head-side chamber of a lift actuator for the linkage.

3. The method of claim 2 wherein the step of resting further includes a step of decreasing down force of the implement to the controlled down force.

4. The method of claim 1 wherein the implement includes a bucket having an attached substrate protection pad, and wherein the step of resting occurs during moving the machine such that the substrate protection pad slides in contact with the substrate.

5. The method of claim 1 wherein the step of adjusting the pressure further includes conveying hydraulic fluid to the hydraulic actuator at a down force controlling pressure which is less than the pump outlet pressure.

6. The method of claim 5 wherein conveying hydraulic fluid further includes conveying the hydraulic fluid from the hydraulic pump to a head-side chamber of the hydraulic actuator by way of a reducing valve that includes the second valve.

7. The method of claim 6 further comprising a step of electronically reading stored implement type data, and stored valve state data, and further comprising a step of moving the reducing valve responsive to the implement type data and the valve state data.

8. The method of claim 1 further comprising a step of charging an accumulator during the step of resting.

9. A machine comprising:

a frame;

ground engaging propulsion elements coupled with the frame;

a hydraulically actuated implement system coupled with the frame, and including a linkage configured to couple with an implement, a hydraulic actuator coupled with the linkage, and a hydraulic pump fluidly connected to an inlet passage formed in a valve assembly having a first valve and an electrically actuated second valve;

the first valve being movable between a first position fluidly connecting the hydraulic actuator to the inlet passage and a second, neutral position at which the fluid connection via the first valve is shut, and the electrically actuated second valve being movable between a first position fluidly connecting the hydraulic actuator to the inlet passage and a second position at which the fluid connection via the second valve is shut; and an electronic control unit in control communication with the electrically actuated second valve, the electronic control unit being configured to receive an implement down force control command, and responsively adjust a pressure of hydraulic fluid in the hydraulic actuator via moving the electrically actuated second valve from its second position to its first position, such that hydraulic fluid is reduced in pressure by the electrically actuated second valve from the pump outlet pressure in the inlet passage to an adjusted pressure, and the implement rests with a controlled down force upon a substrate below the machine which is based on the adjusted pressure and is less than a quiescent down force of the hydraulically actuated implement system;

the electronic control unit being further configured to electronically read stored implement type data, and stored valve state data, and to move the electrically actuated second valve between its first and second positions responsive to the implement type data and the valve state data.

10. The machine of claim 9 wherein the linkage includes a lift arm pivotably coupled with the frame, wherein the hydraulic actuator includes a lift actuator, and wherein the implement is pivotably coupled with the lift arm and the hydraulically actuated implement system further includes a tilt actuator coupled with the implement.

11. The machine of claim 10 wherein the implement includes a bucket.

12. The machine of claim 10 wherein the electrically actuated second valve includes an electrically actuated reducing valve.

13. The machine of claim 12 wherein the hydraulically actuated implement system further includes a primary hydraulic control circuit, a ride control hydraulic circuit, and a down force control circuit that includes the electrically actuated reducing valve.

14. The machine of claim 9 wherein the electronic control unit is further configured to increase the hydraulic pressure in a head-side chamber of the hydraulic actuator such that down force of the implement on the substrate is decreased to the controlled down force.

15. A hydraulically actuated implement system for a machine comprising:

a hydraulic actuator configured to raise and lower a linkage coupled with an implement;

a hydraulic pump;

a valve assembly having an inlet passage formed therein and fluidly connected to the hydraulic pump, a first valve, and an electrically actuated second valve;

the first valve being movable between a first position fluidly connecting the hydraulic actuator to the inlet passage and a second, neutral position at which the fluid connection via the first valve is shut, and the electrically actuated second valve being movable between a first position fluidly connecting the hydraulic actuator to the inlet passage and a second position at which the fluid connection via the second valve is shut;

an input device configured to generate an implement down force control command; and an electronic control unit coupled with the input device and in control communication with the electrically actuated second valve, the electronic control unit being configured to receive the implement down force control command and responsively command adjusting a pressure of hydraulic fluid in the hydraulic actuator via moving the electrically actuated second valve from its second position to its first position to open the fluid connection via the second valve, such that hydraulic fluid is reduced in pressure by the electrically actuated second valve from the pump outlet pressure in the inlet passage to an adjusted pressure and the implement rests with a controlled down force upon a substrate below the machine which is based on the adjusted pressure and is less than a quiescent down force of the hydraulically actuated implement system;

the electronic control unit being further configured to electronically read stored implement type data, and stored valve state data, and to move the electrically actuated second valve between its first and second positions responsive to the implement type data and the valve state data.

16. The system of claim 15 wherein the second valve includes an electrically actuated reducing valve, wherein the electronic control unit is configured to command adjusting the pressure of hydraulic fluid via a control signal to the electrically actuated reducing valve.

* * * * *